US008453918B2

(12) United States Patent
Hsiao et al.

(10) Patent No.: US 8,453,918 B2
(45) Date of Patent: Jun. 4, 2013

(54) HAND-HELD PACKAGE BOX AND DEVELOPED PLATE THEREOF

(75) Inventors: Su-Mei Hsiao, Keelung (TW); Yueh-Hui Huang, Taipei (TW)

(73) Assignee: Sercomm Corporation, Taipei (TW)

( * ) Notice: Subject to any disclaimer, the term of this patent is extended or adjusted under 35 U.S.C. 154(b) by 365 days.

(21) Appl. No.: 12/792,900

(22) Filed: Jun. 3, 2010

(65) Prior Publication Data

US 2011/0297738 A1 Dec. 8, 2011

(51) Int. Cl.
*B65D 5/46* (2006.01)

(52) U.S. Cl.
USPC ..... 229/117.09; 229/120.08; 206/806

(58) Field of Classification Search
USPC ..... 229/117.09, 117.13, 223, 120.02, 229/120.08, 120.14, 120.15, 120.24
See application file for complete search history.

(56) References Cited

U.S. PATENT DOCUMENTS

| | | | | |
|---|---|---|---|---|
| 4,344,533 | A * | 8/1982 | Olsen | 206/459.5 |
| 5,566,831 | A * | 10/1996 | Swenson | 206/767 |
| 6,250,542 | B1 * | 6/2001 | Negelen | 229/117.16 |
| 6,279,819 | B1 * | 8/2001 | Schultz | 229/117.14 |
| 2006/0278689 | A1 * | 12/2006 | Boshinski et al. | 229/117.16 |
| 2010/0084460 | A1 * | 4/2010 | Lo Duca | 229/223 |

* cited by examiner

*Primary Examiner* — Nathan J Newhouse
*Assistant Examiner* — Christopher Demeree
(74) *Attorney, Agent, or Firm* — McClure, Qualey & Rodack, LLP

(57) ABSTRACT

A hand-held package box and a developed plate thereof are provided. The package box includes a box body, a first plate, a second plate and a third plate. The third plate is connected to the box body, and the second plate connects the first plate and the third plate. The first plate has a first folded sheet, and the second plate has a second folded sheet. A position of the first folded sheet and a position of the second folded sheet are symmetrical with respect to a folding line between the first plate and the second plate. When the first plate is folded to a position between the second plate and the third plate, a folding line of the first folded sheet corresponds to a folding line of the second folded sheet, so that the first folded sheet and the second folded sheet, after being folded, form a handle.

11 Claims, 7 Drawing Sheets

HAND-HELD PACKAGE BOX AND DEVELOPED PLATE THEREOF

BACKGROUND OF THE INVENTION

1. Field of the Invention

The invention relates in general to a hand-held package box and a developed plate thereof, and more particularly to a hand-held package box having a handle, and a developed plate thereof.

2. Description of the Related Art

A typical product, such as a home appliance or a computer associated product, is packaged by a box before shipment to protect the electronic product and prevent any damage from being caused during the shipment. When the product is being packaged for the shipment, a plastic handle and a carton are usually provided. The carton covers the product to protect the product, and the plastic handle can be held by a hand.

However, the time for preparing the carton and the plastic handle has to be spent, and the time for assembling the carton and the plastic handle together also has to be wasted. This kind of design cannot reduce the number of elements, and cannot satisfy the requirement of green product design.

SUMMARY OF THE INVENTION

The invention is directed to a hand-held package box and a developed plate thereof, wherein a handle of the hand-held package box and a box body of the hand-held package box are integrally formed, and the handle can replace the conventional plastic handle so that the hand-held package box satisfies the requirement of the green product design, the time of assembling the plastic handle may be saved, and the performance of manufacturing the hand-held package box can be enhanced.

According to a first aspect of the present invention, a hand-held package box is provided. The hand-held package box includes a box body, a first plate, a second plate and a third plate. The third plate is connected to the box body. The second plate connects the first plate and the third plate. The first plate has a first folded sheet. The second plate has a second folded sheet. A position of the first folded sheet and a position of the second folded sheet are symmetrical with respect to a first folding line between the first plate and the second plate. When the first plate is folded to a position between the second plate and the third plate, a folding line of the first folded sheet corresponds to a folding line of the second folded sheet, so that the first folded sheet and the second folded sheet, after being folded, form a handle.

According to a second aspect of the present invention, a developed plate is provided. The developed plate is to be folded into a hand-held package box. The developed plate includes a box body plate assembly, a first plate, a second plate and a third plate. The box body plate assembly is to be folded into a box body. The third plate is connected to the box body plate. The second plate connects the first plate and the third plate. The first plate has a first folded sheet. The second plate has a second folded sheet. The position of the first folded sheet and the position of the second folded sheet are symmetrical with respect to a folding line between the first plate and the second plate. When the first plate is folded to a position between the second plate and the third plate, a folding line of the first folded sheet corresponds to a folding line of the second folded sheet, so that the first folded sheet and the second folded sheet, after being folded, form a handle.

The invention will become apparent from the following detailed description of the preferred but non-limiting embodiments. The following description is made with reference to the accompanying drawings.

DETAILED DESCRIPTION OF THE INVENTION

Figure 1:
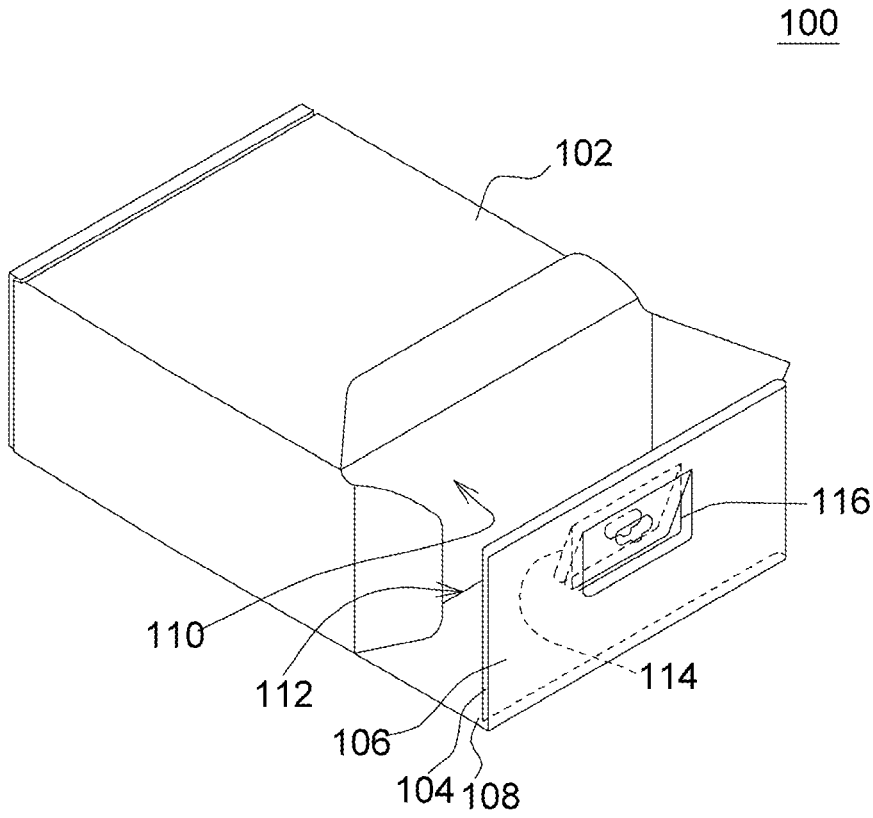
FIG. 1 is a schematic illustration showing a hand-held package box according to a preferred embodiment of the invention.
Figure 2:
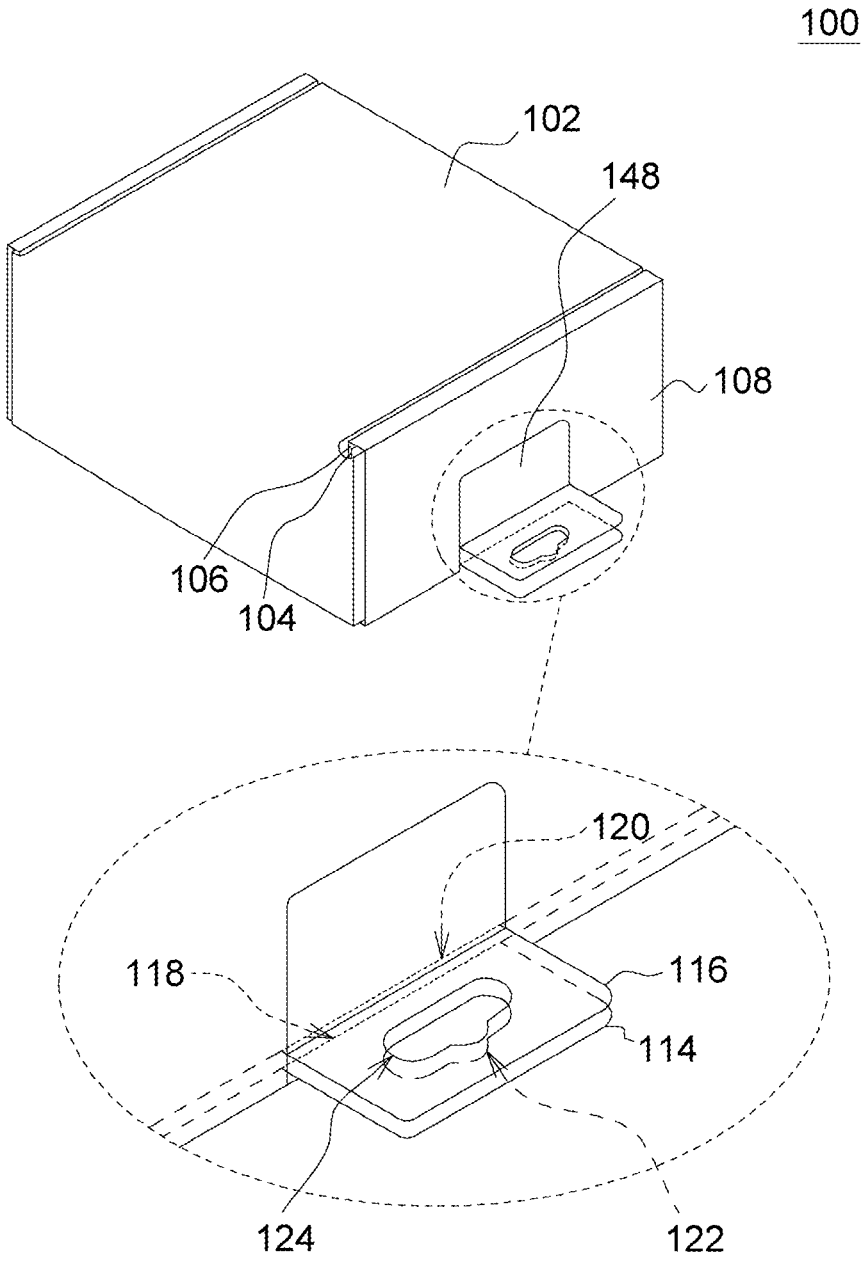
FIG. 2 is a schematic illustration showing that a first folded sheet and a second folded sheet in FIG. 1 are folded into a handle.

FIG. 1 is a schematic illustration showing a hand-held package box 100 according to a preferred embodiment of the invention. FIG. 2 is a schematic illustration showing that a first folded sheet and a second folded sheet in FIG. 1 are folded into a handle. As shown in FIG. 1, the hand-held package box 100 includes a box body 102, a first plate 104, a second plate 106 and a third plate 108. The hand-held package box 100 may accommodate various products such as stationery, portable electronic device and communication device. Taking an electronic product as an example, the hand-held package box 100 may accommodate a memory disk, a speaker, a hard disk, an optical drive, a modem, a notebook computer, a personal digital assistant (PDA) or the like.

The box body 102 has an opening 110. The third plate 108 is connected to a first side 112 of the opening 110. The second plate 106 is connected to the first plate 104 and the third plate 108. The first plate 104 has a first folded sheet 114. The second plate 106 has a second folded sheet 116. As shown in FIG. 2, when the first plate 104 is folded to a position between the second plate 106 and the third plate 108, a folding line 118 of the first folded sheet 114 corresponds to a folding line 120 of the second folded sheet 116. That is, the folding line 118 of the first folded sheet 114 substantially overlaps with the folding line 120 of the second folded sheet 116 so that the first folded sheet 114 and the second folded sheet 116, after being folded, form a handle to be held and lifted by the user or a tool. In this invention, the term "overlap" represents the positional overlap between two elements, and the overlapped two elements may contact each other or may be separated from each other.

Because a plastic handle is replaced by the first folded sheet 114 and the second folded sheet 116 in this hand-held package box 100 of the invention, the requirement of the green product design may be satisfied. In addition, when the hand-held package box 100 is being manufactured, it is unnecessary to manufacture the plastic handle so that the cost and the time of assembling the plastic handle may be saved.

After the first plate 104 overlaps with the second plate 106, a two-layer structure is formed. The handle having the two-layer structure has the excellent structural strength so that the handle of the hand-held package box 100 can withstand the larger pulling force. According to the experimental data, the handle can withstand the pulling force larger than 10 kilograms. Consequently, the hand-held package box 100 can accommodate more types of products, including the heavier electronic product, such as the notebook computer.

In addition, the first folded sheet 114 has a first through portion 122, and the second folded sheet 116 has a second through portion 124. The tool or the finger of the user can pass through the first through portion 122 and the second through portion 124 to lift up the hand-held package box 100.

Figure 3:
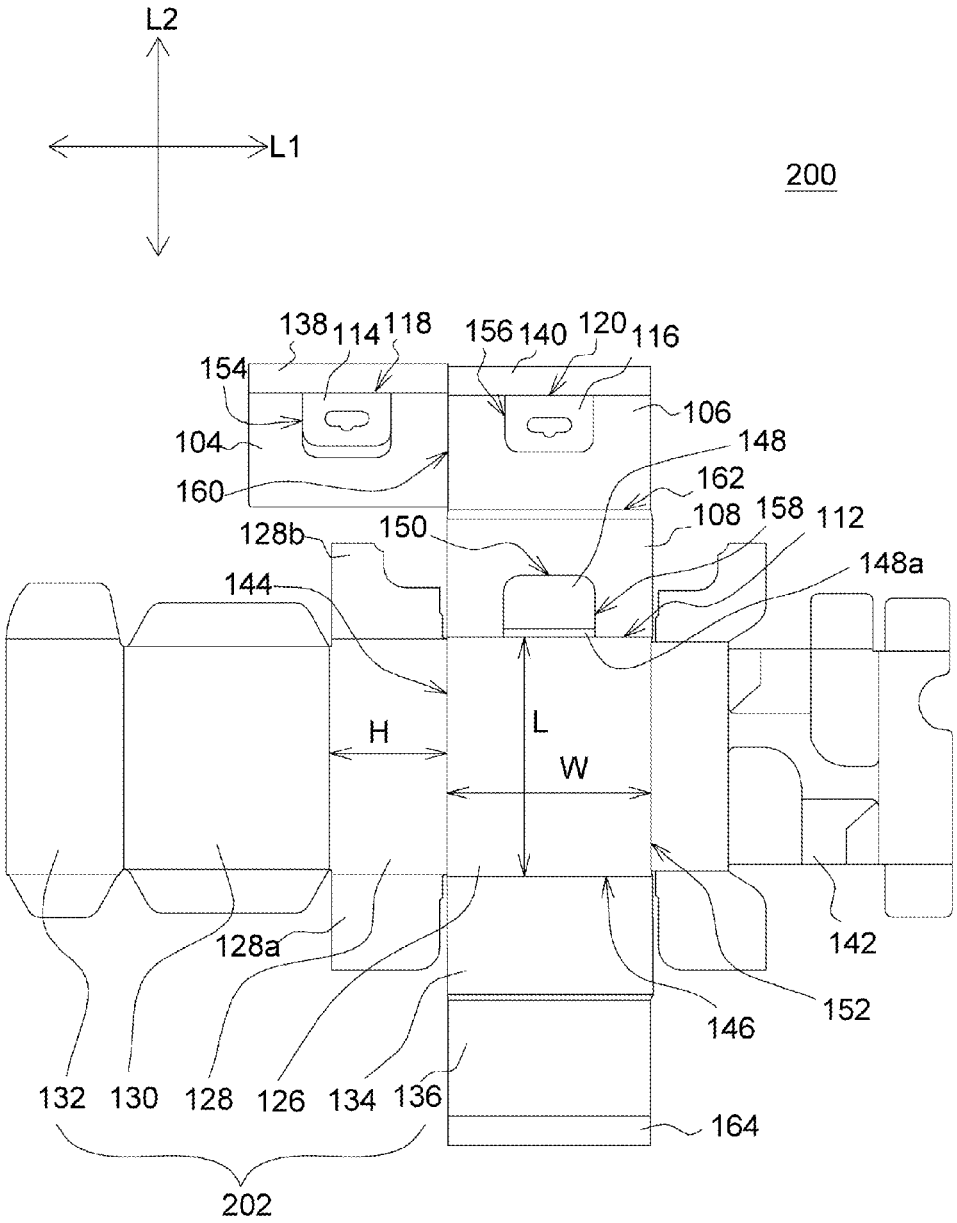
FIG. 3 is a developed view showing a developed plate of the hand-held package box according to the preferred embodiment of the invention.
Figure 4:
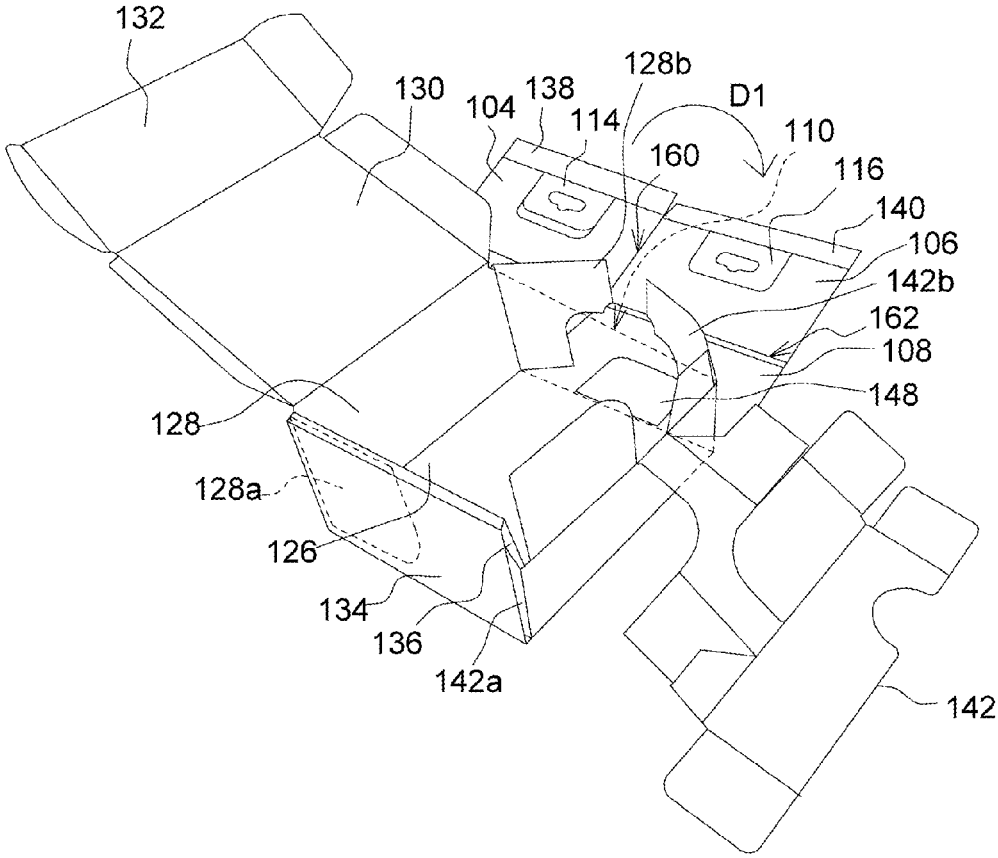
FIGS. 4 to 6 are schematic illustrations showing a portion of the developed plate of FIG. 3 being folded.
Figure 5:
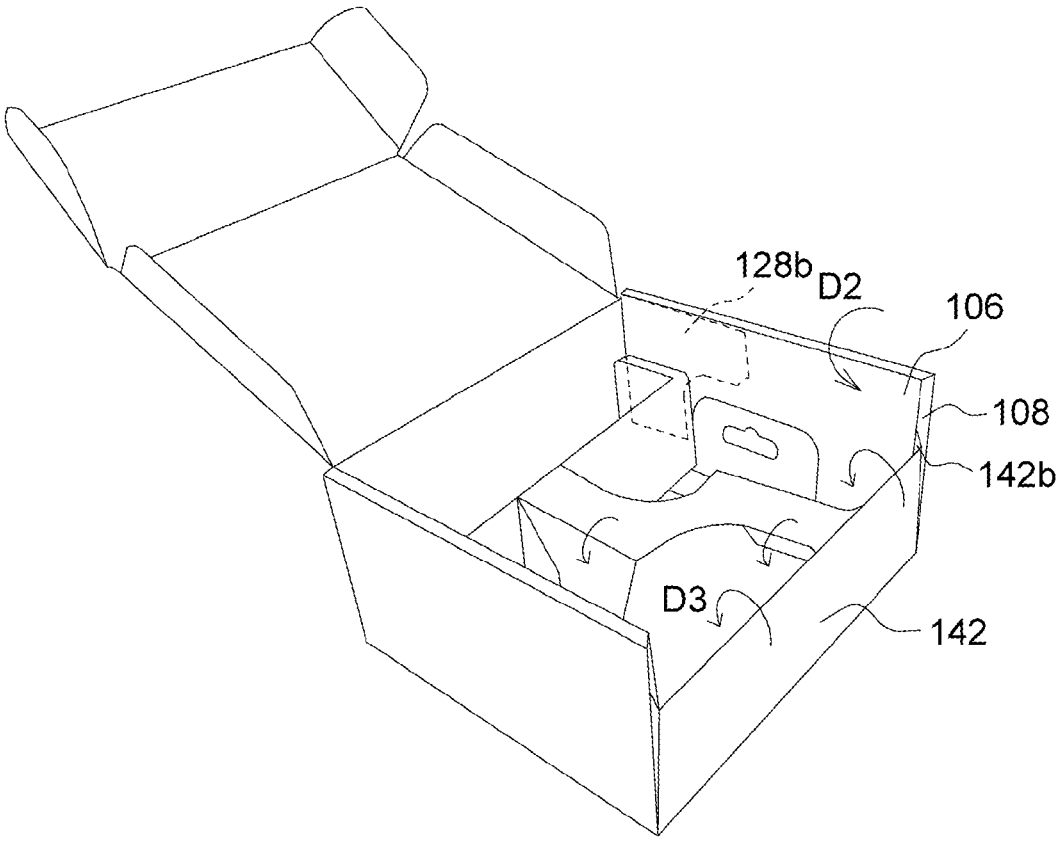
Figure 6:
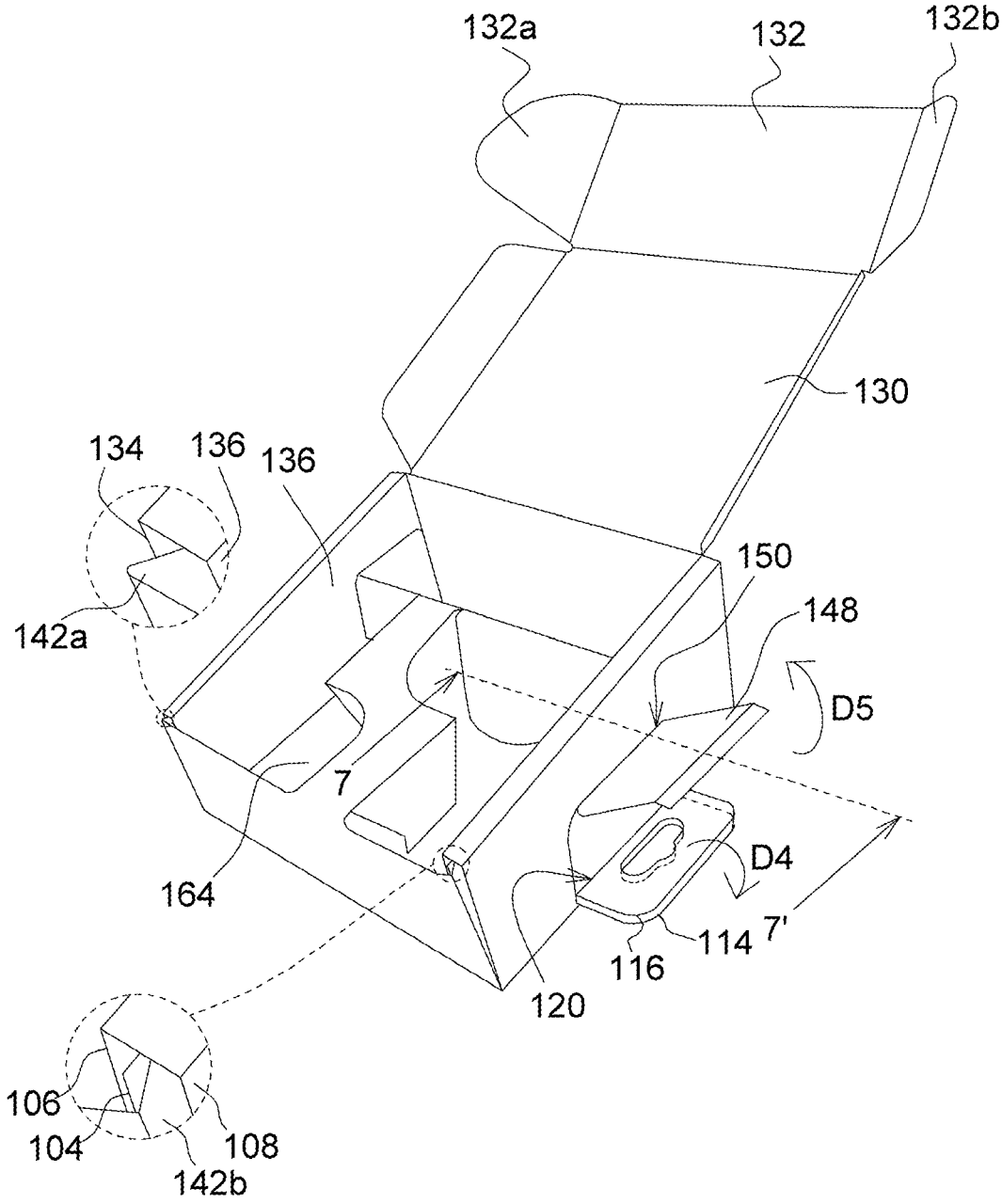

FIG. 3 is a developed view showing a developed plate 200 of the hand-held package box 100 according to the preferred embodiment of the invention. FIGS. 4 to 6 are schematic illustrations showing a portion of the developed plate 200 of FIG. 3 being folded. As shown in FIG. 3, the developed plate 200 may be folded into the hand-held package box 100 and the material thereof may be a corrugated sheet board, for example.

Referring to FIG. 3, the developed plate 200 includes a box body plate assembly 202, the first plate 104, the second plate 106, the third plate 108, a receiving plate 142, a folded portion 148*a* and resting sheets 138 and 140.

The shapes and positions of the first folded sheet 114 of the first plate 104 and the second folded sheet 116 of the second plate 106 are substantially symmetrical with respect to a first folding line 160 between the first plate 104 and the second plate 106. Thus, as shown in FIG. 4, when the first plate 104 is folded to the second plate 106 in a direction D1, the first folded sheet 114 overlaps with the second folded sheet 116.

Similarly, the shapes and positions of the second folded sheet 116 of the second plate 106 and a third folded sheet 148 of the third plate 108 are substantially symmetrical with respect to a second folding line 162 between the second plate 106 and the third plate 108, wherein the first folding line 160 is substantially perpendicular to the second folding line 162. Thus, as shown in FIG. 5, after the second plate 106 is folded to the third plate 108 in a direction D2, the second folded sheet 116 overlaps with the third folded sheet 148.

In summary, the first plate 104 may be folded to a position between the second plate 106 and the third plate 108 so that the first folded sheet 114, the second folded sheet 116 and the third folded sheet 148 overlap with one another. After the first folded sheet 114, the second folded sheet 116 and the third folded sheet 148 overlap with one another, a position of a folding line 150 of the third folded sheet 148 is opposite to the folding line 120 of the second folded sheet 116, as shown in FIG. 6.

Figure 7:
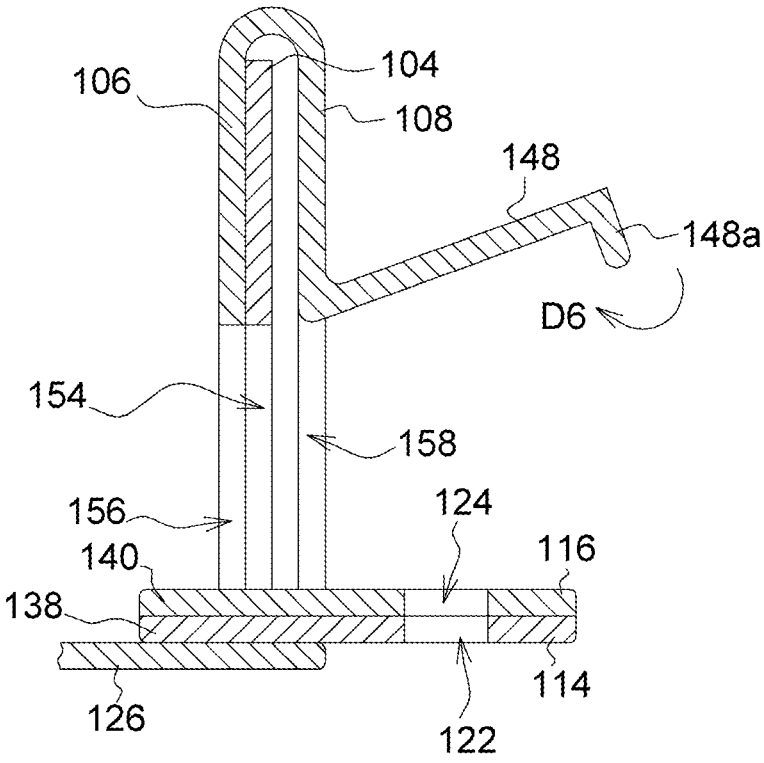
FIG. 7 is a cross-sectional view taken along a direction 7-7' of FIG. 6.

FIG. 7 is a cross-sectional view taken along a direction 7-7' of FIG. 6. As shown in FIGS. 3 and 7, the first folded sheet 114 of the first plate 104 is moveable about the folding line 118 to selectively expose a through hole 154 (see FIG. 7), the second folded sheet 116 of the second plate 106 is moveable about the folding line 120 to selectively expose a through hole 156 (see FIG. 7), and the third folded sheet 148 of the third plate 108 is moveable about the folding line 150 to selectively expose a through hole 158 (see FIG. 7). When the first plate 104 is folded to a position between the second plate 106 and the third plate 108, the positions of the through holes 154, 156 and 158 substantially overlap with one another, as shown in FIG. 7.

As shown in FIG. 3, the box body plate assembly 202 after being folded can form the box body 102. The box body plate assembly 202 includes a fourth plate 126, a fifth plate 128, a sixth plate 130, a seventh plate 132, an eighth plate 134 and a ninth plate 136.

As shown in FIG. 3, the first plate 104, the second plate 106, the third plate 108, the fourth plate 126, the fifth plate 128, the sixth plate 130, the seventh plate 132, the eighth plate 134, the ninth plate 136, receiving plate 142 and the resting sheets 138, 140 and 164 are integrally formed. That is, the developed plate 200 is formed by cutting a single board.

In order to package the medium and small products, the dimensions of the developed plate 200 may be properly designed to prevent the wastage of the package material. For example, the fourth plate 126 of the developed plate 200 has a length L equal to about 162 millimeters (mm), and a width W equal to about 138 mm. In addition, the fifth plate 128 has a height H equal to about 80 mm so that the folded hand-held package box 100 forms a package box having the size of about 162 mm×138 mm×80 mm. However, these dimensions do not intend to restrict the invention. In another embodiment of the invention, the dimensions of the developed plate 200 may be determined according to the dimensions of the larger electronic product or any other products, and are not restricted by the examples of this invention.

In FIG. 3, the fourth plate 126, the fifth plate 128, the sixth plate 130, the seventh plate 132 and the receiving plate 142 are substantially arranged in a first straight line direction L1, while the second plate 106, the third plate 108, the fourth plate 126, the eighth plate 134 and the ninth plate 136 are substantially arranged in a second straight line direction L2 substantially perpendicular to the first straight line direction L1.

Specifically speaking, the fifth plate 128 is connected to a second side 144 of the fourth plate 126, and the sixth plate 130 is connected to the fifth plate 128 and the seventh plate 132. The folding lines between the fifth plate 128, the sixth plate 130 and the seventh plate 132 are substantially parallel to the second straight line direction L2. The receiving plate 142 is connected to a fourth side 152 of fourth plate 126, wherein the fourth side 152 is opposite to the second side 144. In addition, the third plate 108 is connected to the first side 112 of the fourth plate 126, the ninth plate 136 is connected to the eighth plate 134, and the eighth plate 134 is connected to a third side 146 of the fourth plate 126. The first side 112 is opposite to the third side 146. The folding lines between the second plate 106, the third plate 108, the fourth plate 126, the eighth plate 134 and the ninth plate 136 are substantially parallel to the first straight line direction L1.

The structure of the hand-held package box 100 will be described in detail with reference to FIGS. 4 to 6.

Referring to FIG. 4, the fifth plate 128 includes a first side wing 128*a* and a first side wing 128*b* opposite to the first side wing 128*a*, and the receiving plate 142 includes a second side wing 142*a* and a second side wing 142*b* opposite to the second side wing 142*a*. The first side wing 128*a* and the second side wing 142*a* may be folded to a position between the eighth plate 134 and the ninth plate 136.

After the fourth plate 126, the fifth plate 128, the sixth plate 130 and the seventh plate 132 of FIG. 4 are folded, a tetrahedron surrounding the opening 110 may be formed.

In addition, the first plate 104 is connected to one side of the second plate 106, so that the first folding line 160 between the first plate 104 and the second plate 106 is substantially parallel to the first straight line direction L1, as shown in FIG. 3. The first plate 104 may be folded to the second plate 106 in the direction D1 so that the first plate 104 and the second plate 106 form a two-layer structure. As shown in FIG. 5, the overlapped first plate 104 and second plate 106 may be folded into the box body 102 in the direction D2. In this case, the first side wing 128*b* and the second side wing 142*b* may be folded to a position between the third plate 108 and the second plate 106.

As shown in FIG. 5, the receiving plate 142 may be folded into the box body 102 in a direction D3 to receive, support or package the product. Because the receiving plate 142 and the box body plate assembly 202 are integrally formed, it is unnecessary to manufacture the receiving plate 142 using a mold. So, the cost of forming the mold, the assembling cost and the assembling time can be saved.

As shown in FIG. 6, the positions of the first folded sheet 114 and the second folded sheet 116 substantially overlap with each other and the folding line 118 of the first folded sheet 114 and the folding line 120 of the second folded sheet 116 are disposed on the same side of the overlapped through holes 154 and 156 (see FIG. 7). So, the first plate 104 and the second plate 106, which are stacked together and shown in FIG. 5, may be pushed out in a direction D4, so that the overlapped first plate 104 and second plate 106 form the handle. Because the first plate 104, the second plate 106 and the box body plate assembly 202 are integrally formed, it is unnecessary to manufacture the first plate 104 and the second plate 106 using molds. So, the cost of forming the molds, the assembling cost and the assembling time can be saved.

In addition, the third folded sheet 148 of the third plate 108 shown in FIG. 6 may be pushed out in a direction D5. The folding line 150 of the third folded sheet 148 is opposite to the folding line 120 of the second folded sheet 116 and the folding line 118 (not illustrated in FIG. 6) of the first folded sheet 114. According to the moveable first folded sheet 114, second folded sheet 116 and third folded sheet 148, first folded sheet 114, second folded sheet 116 and the third folded sheet 148 can selectively expose or shield the through hole 154, 156 and 158 (the through hole 154, 156 and 158 illustrated in FIG. 7). For example, as shown in FIG. 7, the third folded sheet 148 and the overlapped first folded sheet 114 and second folded sheet 116 commonly expose the overlapped through holes 154, 156 and 158. Alternatively, as shown in FIG. 2, the third folded sheet 148 shields the through hole 158, and only the overlapped first folded sheet 114 and second folded sheet 116 expose the overlapped through holes 154 and 156. Because the third folded sheet 148 of FIG. 2 shields the through hole 158, it is possible to prevent particles or liquids from entering the box body 102. Alternatively, in another embodiment, the overlapped first folded sheet 114 and second folded sheet 116 in FIG. 6 may be folded into the box body 102, and then the third folded sheet 148 is folded in a direction opposite the direction D5 folded to the position of shielding the through hole 158, so that the first folded sheet 114, the second folded sheet 116 and the third folded sheet 148 commonly shield the overlapped through holes 154, 156 and 158. In addition, it is possible to prevent the particles from entering the box body 102 as long as one of the through holes 154, 156 and 158 is shielded.

Referring to FIG. 6, the seventh plate 132 includes opposite third side wings 132*a* and 132*b*. The third side wing 132*b* of FIG. 6 may be folded to the position between the second side wing 142*b* of the receiving plate 142 and the third plate 108, and the third side wing 132*a* of FIG. 6 may be folded to the position between the eighth plate 134 and the second side wing 142*a* of the receiving plate 142, so that the hand-held package box 100 is in a closed state to prevent the particles or liquids from entering the box body 102.

As shown in FIG. 7, the resting sheet 138 is connected to the first plate 104 and the first folded sheet 114, and the resting sheet 140 is connected to the second plate 106 and the second folded sheet 114. The resting sheets 138 and 140 are to be folded into the box body 102 and rest against the fourth plate 126. Consequently, the first plate 104 and the second plate 106 may be disposed in the box body 102 more firmly and cannot be arbitrarily shaken. However, this does not intend to restrict the invention. In another embodiment, the resting sheets 138 and 140 may also be omitted from the hand-held package box 100.

In addition, the resting sheet 164 (see FIGS. 3 and 6) is connected to the ninth plate 136 and has the characteristics similar to those of the resting sheets 138 and 140, so detailed descriptions thereof will be omitted.

In addition, the folded portion 148*a* shown in FIG. 7 is connected to the third folded sheet 148. After the third folded sheet 148 shields the through hole 158, the folded portion 148*a* may rest against the second folded sheet 116 to prevent the third folded sheet 148 from being arbitrarily shaken. In addition, although the folded portion 148*a* of FIG. 7 is folded in a direction D6, this does not intend to restrict the invention. In other embodiments, the folded portion 148*a* may also be folded in the direction opposite the direction D6. In this case, the third folded sheet 148 may be easily opened by pulling the folded portion 148*a*.

The hand-held package box and the developed plate thereof according to the embodiment of the invention have many advantages, some of which will be described in the following.

First, the box body, the first plate and the second plate of the hand-held package box are integrally formed, wherein the first plate and the second plate may form the handle, which can replace the conventional plastic handle so that the hand-held package box satisfies the requirement of the green product design and the time of assembling the plastic handle may be saved.

Second, the first plate overlaps with the second plate to form the two-layer structure so that the hand-held package box can withstand the larger pulling force to withstand the heavier and diversified products.

Third, after the third folded sheet shields the through hole, the folded portion of the third folded sheet can rest against the second folded sheet to prevent the third folded sheet from being arbitrarily shaken.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A hand-held package box, comprising:

a box body;

a first plate, a second plate and a third plate, wherein the third plate is connected to the box body, the second plate connects the first plate and the third plate, the first plate has a first folded sheet, the second plate has a second folded sheet, and the position of the first folded sheet and the position of the second folded sheet are symmetrical with respect to a first folding line between the first plate and the second plate, wherein when the first plate is folded to a position between the second plate and the third plate, a folding line of the first folded sheet corresponds to a folding line of the second folded sheet, so that the first folded sheet and the second folded sheet, after being folded, form a handle; and a resting sheet, connected to the first plate and folded into the box body and resting against a fourth plate connected to the third plate;

wherein the first plate and the second plate are arranged in a first straight line direction, and the second plate and the third plate are arranged in a second straight line direction substantially perpendicular to the first straight line direction, such that the first plate, the second plate and the third plate together form a L-shaped plate.

2. The hand-held package box according to claim 1, wherein the first folded sheet has a first through portion, the first folded sheet has a second through portion, and the first through portion overlaps with the second through portion after the first folded sheet and the second folded sheet are folded.

3. The hand-held package box according to claim 1, wherein the third plate has a third folded sheet, the position of the third folded sheet and the position of the second folded sheet are symmetrical with respect to a second folding line between the third plate and the second plate, the first folding line is substantially perpendicular to the second folding line, and a folding line of the third folded sheet is opposite to the folding line of the second folded sheet and the folding line of the first folded sheet when the first plate is folded to a position between the second plate and the third plate.

4. The hand-held package box according to claim 3, further comprising:

a receiving plate, connected to a fourth side of the fourth plate and folded into the box body, wherein the fourth side is opposite to the second side.

5. The hand-held package box according to claim 1, wherein the box body comprises the fourth plate, a fifth plate, a sixth plate, a seventh plate, an eighth plate and a ninth plate;

wherein, the third plate, the fifth plate and the eighth plate are connected to a first side, a second side and a third side of the fourth plate respectively, the sixth plate connects the fifth plate and the seventh plate, the ninth plate is connected to the eighth plate, and the first side is opposite to the third side.

6. A developed plate to be folded into a hand-held package box, the developed plate comprising:

a box body plate assembly to be folded into a box body; and a first plate, a second plate and a third plate, wherein the third plate is connected to the box body, the second plate connects the first plate and the third plate, the first plate has a first folded sheet, the second plate has a second folded sheet, and an shape of the first folded sheet and an shape of the second folded sheet are symmetrical with respect to a first folding line between the first plate and the second plate, wherein when the first plate is folded to a position between the second plate and the third plate, a folding line of the first folded sheet corresponds to a folding line of the second folded sheet, so that the first folded sheet and the second folded sheet, after being folded, form a handle; and a resting sheet connected to the first plate and folded into the box body and resting against a fourth plate connected to the third plate;

wherein the first plate and the second plate are arranged in a first straight line direction, and the second plate and the third plate are arranged in a second straight line direction substantially perpendicular to the first straight line direction, such that the first plate, the second plate and the third plate together form a L-shaped plate.

7. The developed plate according to claim 6, wherein the first folded sheet has a first through portion, the first folded sheet has a second through portion, and the first through portion overlaps with the second through portion after the first folded sheet and the second folded sheet are folded.

8. The developed plate according to claim 6, wherein the third plate has a third folded sheet, a position of the third folded sheet and a position of the second folded sheet are symmetrical with respect to a second folding line between the third plate and the second plate, the first folding line is substantially perpendicular to the second folding line, and a folding line of the third folded sheet is opposite to the folding line of the second folded sheet and the folding line of the first folded sheet when the first plate is folded to a position between the second plate and the third plate.

9. The developed plate according to claim 6, wherein the box body comprises the fourth plate, a fifth plate, a sixth plate, a seventh plate, an eighth plate and a ninth plate;

wherein, the third plate, the fifth plate and the eighth plate are connected to a first side, a second side and a third side of the fourth plate respectively, the sixth plate connects the fifth plate and the seventh plate, the ninth plate is connected to the eighth plate, and the first side is opposite to the third side.

10. The developed plate according to claim 9, wherein the fourth plate, the fifth plate, the sixth plate and the seventh plate are arranged in the first straight line direction, and the second plate, the third plate, the fourth plate, the eighth plate and the ninth plate are arranged in the second straight line direction substantially perpendicular to the first straight line direction.

11. The developed plate according to claim 9, further comprising:

a receiving plate, connected to a fourth side of the fourth plate and folded into the box body, wherein the fourth side is opposite to the second side.

* * * * *